United States Patent [19]

Clark et al.

[11] Patent Number: 4,921,195

[45] Date of Patent: May 1, 1990

[54] PLASTIC BAG STAND

[76] Inventors: Emmit S. Clark, 38660 Lexington, #440, Fremont, Calif. 94536; Leslie Will, P.O. Box 8310, San Jose, Calif. 95155

[21] Appl. No.: 294,010

[22] Filed: Jan. 3, 1989

[51] Int. Cl.[5] ..... B65B 67/04

[52] U.S. Cl. ..... 248/97; 220/1 T; 220/404; 248/101

[58] Field of Search ..... 248/95, 97, 98, 99, 248/100, 101; 220/1 T, 403, 404

[56] References Cited

U.S. PATENT DOCUMENTS

| | | | |
|---|---|---|---|
| 957,652 | 5/1910 | Bush | 248/97 |
| 1,971,642 | 8/1934 | Champlin | 248/97 |
| 2,470,977 | 5/1949 | Chidsey, Jr. | 248/97 |
| 3,443,745 | 5/1969 | Kleeberg | 248/101 X |
| 3,522,922 | 8/1970 | Byron et al. | 248/101 |
| 3,633,859 | 1/1972 | Vosbikian | 248/97 |
| 3,771,752 | 11/1973 | Meeh | 248/101 X |
| 4,332,361 | 6/1982 | McClellan | 248/95 |
| 4,467,989 | 8/1984 | Stroh | 248/97 |
| 4,638,968 | 1/1987 | Auten | 248/97 |
| 4,667,912 | 5/1987 | DeVilbiss | 248/97 |
| 4,690,357 | 5/1987 | Webster | 248/99 |
| 4,802,647 | 2/1989 | Celmayster et al. | 248/97 X |

FOREIGN PATENT DOCUMENTS

| | | | |
|---|---|---|---|
| 70874 | 4/1950 | Denmark | 248/97 |
| 2919859 | 11/1980 | Fed. Rep. of Germany | 248/97 |
| 303978 | 1/1929 | United Kingdom | 248/97 |

*Primary Examiner*—David L. Talbott
*Attorney, Agent, or Firm*—John J. Leavitt

[57] ABSTRACT

Presented in three different aspects is a bag stand for supporting limp plastic bags with or without handles in an upright position. The bag stand is formed by two identical metal frames connected together by connectors to produce a frame having a generally square top shape over which the open mouth of a gusseted plastic bag having handles can be cuffed, with the handles or the cuffed perimeter of the bag hooked in open slots on the connectors, to thus support the normally limp plastic bag in an upright open-mouth condition for the reception of refuse or articles of merchandise. Lateral adjustment can be made to the frame to compensate for variance in size of gusseted plastic bags.

12 Claims, 5 Drawing Sheets

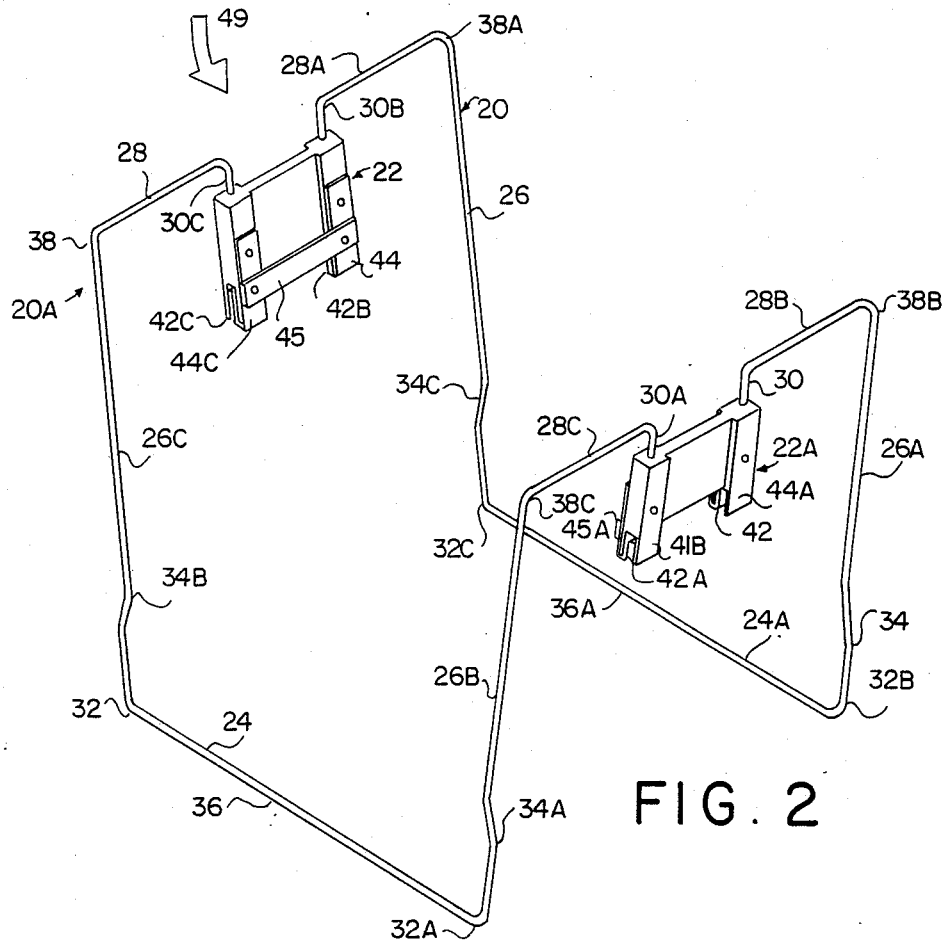
FIG. 2
FIG. 3A
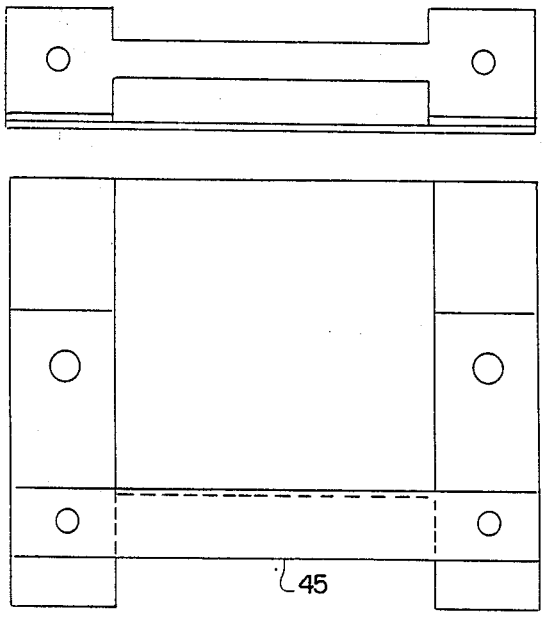
FIG. 3B
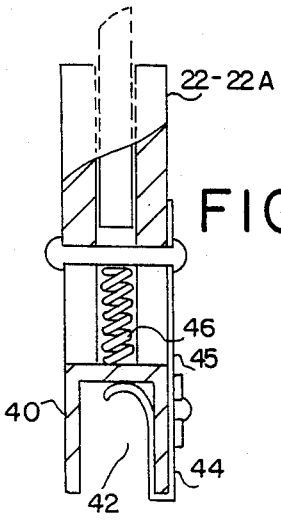
FIG. 3C

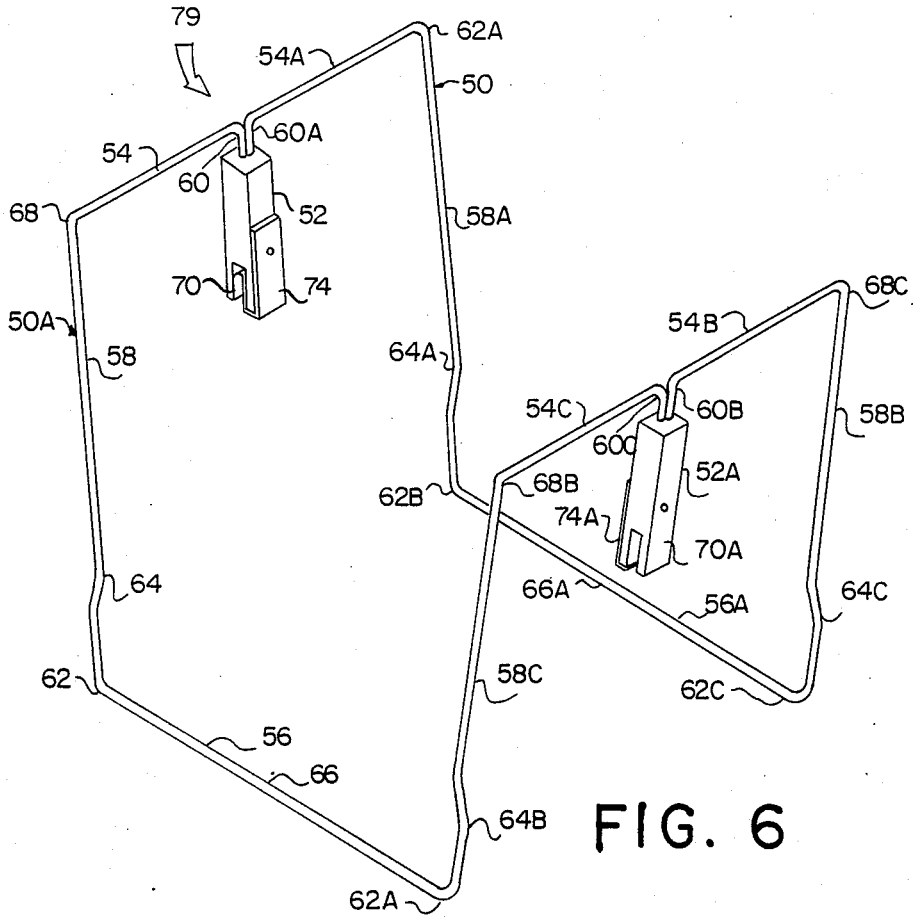
FIG. 6
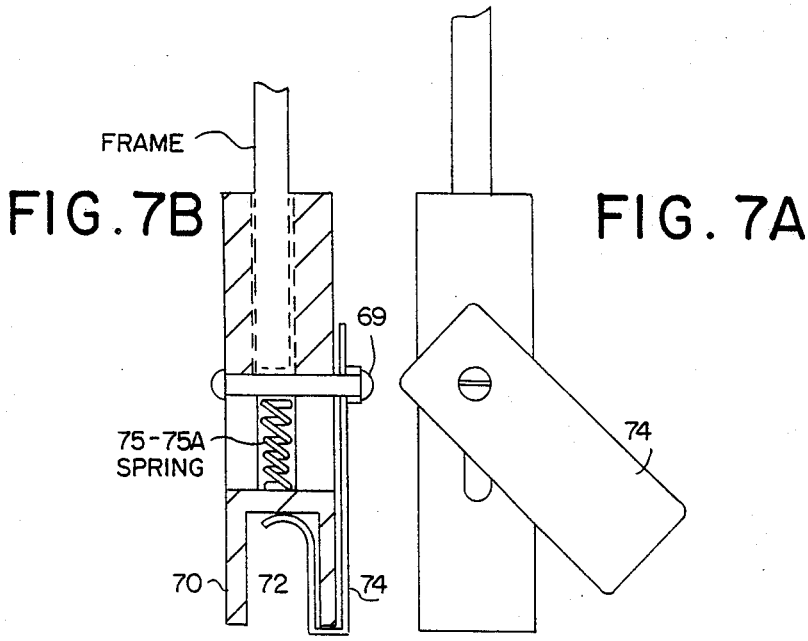
FIG. 7B
FIG. 7A

PLASTIC BAG STAND

BACKGROUND OF THE INVENTION

1. Field of the Invention

This invention relates to a bag stand, and particularly to a stand for gusseted plastic bags with or without handles to be used for the collection of refuse, primarily in the kitchen.

2. Description of the Prior Art

Bag holders have been around for many years. U.S. Pat. No. 36,328 was issued in 1862 for a bag holder used in agriculture. In the past 30–40 years, most households have used large paper bags which can be used alone, i.e., without support, or placed in a supporting metal or plastic container and used to collect household refuse. Recently, however, many stores have replaced these relatively self-supporting paper bags with limp or non-self-supporting plastic bags with handles for carrying merchandise. This change is causing problems for customers. Unlike paper bags, plastic bags are insufficiently rigid to stand upright on their own or even in trash baskets. They need a supporting structure. Patents are being issued now that provide different methods and structures for supporting these thin plastic bags with handles. U.S. Pat. No. 4,664,347 provides for hanging the plastic bag by its handles inside a plastic container. U.S. Pat. No. 4,332,361 provides for a supporting structure which is attached to a vertical surface and on which the plastic bag is hung by the handles. U.S. Pat. No. 4,467,989 provides a self-supporting frame structure on which a limp plastic bag is hung by the handles.

The primary object of our invention is to provide a stable, free standing structure, enabling use of the handles of gusseted plastic bags for support of the bag.

Another object is to provide a sturdy stand for limp plastic bags which is effective to hold the mouth of the bag wide open in a square shape, using the full perimeter of the open end of a gusseted plastic bag.

Still another object is the provision of a sturdy stand for limp plastic bags which is effective to hold open gusseted plastic bags without handles.

We have had occassion to observe households using the type of limp plastic bag that hangs inside a plastic container. These are very unsanitary. There is a small space alongside the hanging bag that lets refuse fall into the container around the outside of the plastic bag. A bad odor from these spills usually results. In a test of a structure similar to U.S. Pat. No. 4,467,989, we found that hanging the limp plastic bag by its handles had the tendency to elongate the opening to 6"–7" on a side, and as it filled up, it tightened the top and made it even smaller. It was apparent to us that putting the limp plastic bags of the type mounted on a vertical surface under the sink such as the structure of U.S. Pat. No. 4,332,361, was troublesome. If the bag was mounted on the swinging door, the full plastic bag would have a tendency to drag as the door was opened and closed.

Accordingly, a still further object of the invention is the provision of a bag holder for limp plastic bags that will fit under a kitchen sink so as to replace the paper bag container used by many families for household refuse.

Yet another object of the invention is the provision of a bag holder for limp plastic bags that is sanitary due to its construction and height, and which can be placed in the dishwasher straddling other dishes and thus be thoroughly sterilized.

A still further object of the invention is a bag holder for limp plastic bags on which several days supply of limp plastic bags with or without handles may be installed for successive use.

Limp plastic bags without handles pose special problems, and it is therefore another object to provide a bag holder provided with integral clamps in the moulded plastic connectors for use with limp plastic bags without handles.

Part of the economic burden of supplying bag stands are shipping costs. Accordingly, another object is the provision of a bag holder that pivots on its plastic connectors to reduce its size 50% for shipping and storage space reduction.

Not all limp plastic bags are of the same size. Accordingly, yet another object of the invention is the provision of a bag hold for limp plastic bags that has provision for lateral adjustment to compensate for variance in size of open limp plastic bag perimeters.

Other objects and features of advantage will become apparent from a consideration of the ensuing description, together with the drawings. It is to be understood however that the invention is not limited by the embodiment illustrated and described since it may be embodied in various forms within the scope of the appended claims.

SUMMARY OF THE INVENTION

In terms of broad inclusion, the bag holder of the invention is designed to provide upright support to a limp plastic bag. In the embodiments of the invention illustrated in FIGS. 2 and 8, a substantially identical pair of frames in each embodiment are adjustably interconnected to enable substantial collapse or diminution of the frame dimensions from an extended bag-supporting position to a collapsed position advantageous for shipping and storage of the bag holders. In the embodiment of FIG. 6, a pair of frames similar to those of FIG. 2 are secured in non-collapsible position by a connector member that also functions to lock a limp bag to the frame. Means are provided in each embodiment for supporting a multiplicity of limp plastic bags in a manner that each bag, successively, may be filled with merchandise while being supported and then enabling the removal of the filled plastic bag from the support frame.

BRIEF DESCRIPTION OF THE DRAWINGS

FIG. 2 is a perspective view similar to FIG. 1 of the extended bag stand, but omitting the plastic bag.

FIGS. 3A, 3B and 3C are top, front, and cross-sectional views, respectively, of the moulded plastic connector that facilitates extension and collapse of the bag holder.

FIG. 6 is a perspective view of a second embodiment of a non-collapsible bag stand for limp plastic bags.

FIGS. 7A and 7B are side and cross-sectional views, respectively, of a single moulded plastic connector of the type used for the non-collapsible bag stand of FIG. 6.

DESCRIPTION OF THE PREFERRED EMBODIMENTS

Figure 1:
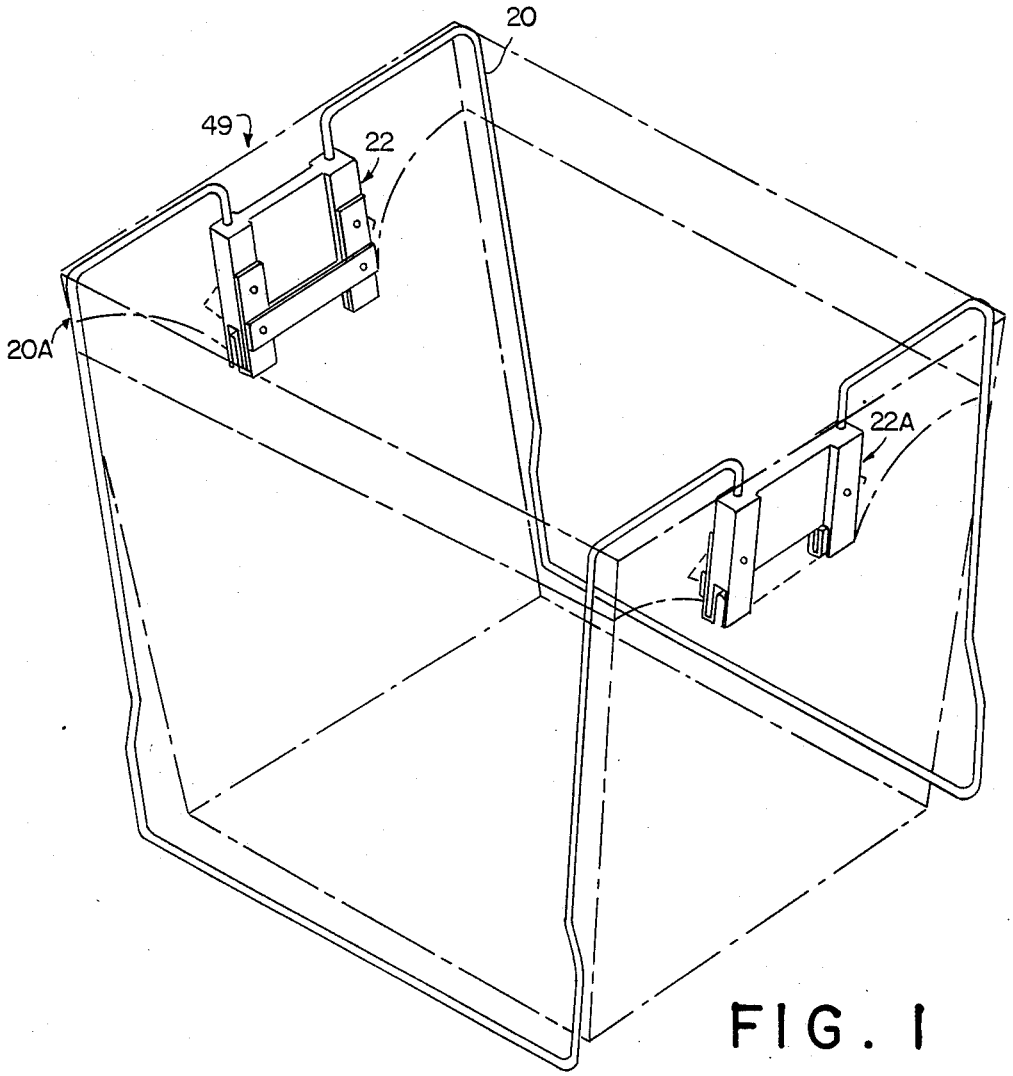
FIG. 1 is a perspective view of the extended bag holder shown in full lines supporting a plastic bag shown in broken lines.

In terms of greater detail, and referring first to the embodiment of the invention illustrated in FIG. 2, the bag stand there shown comprises a two-legged frame designated generally by the numeral 49, the frame configuration formed by bending solid round bar into two individual and substantially identical frame sections designated generally by the numerals 20 and 20A, and which are pivotally connected together by double slotted moulded plastic connectors designated generally by the numerals 22 and 22A to form the plastic bag stand 49 to which gusseted plastic bags, with or without handles, of a predetermined size, with an opening at the top thereof, can be attached and supported. The two frame sections 20 and 20A are mirror images of each other, and each is formed from a continuous solid round bar to provide horizontal supporting sections 24 and 24A by which the bag stand is supported on a support surface. Vertical uprights 26, 26A, 26B and 26C connect integrally with the support sections 24 and 24A and horizontal top sections 28, 28A, 28B and 28C, the latter being perpendicular to and approximately one-third as long as horizontal supporting sections 24 and 24A, and ending in short vertical downward projecting sections 30, 30A, 30B and 30C, all sections of each frame connected together integrally with smooth-radius bends. The two individual frames 20 and 20A are pivotally connected together by the double slotted plastic connectors 22 and 22A shown in detail in FIG. 3 and which are mirror images of each other. Pivotal interconnection of the frames 20 and 20A with the connectors 22 and 22A is effected by inserting the vertical sections 30, 30A, 30B and 30C in appropriate bores as shown in FIG. 3C.

When viewed from the open side as in FIG. 2, the approximate 86 degree bends 32, 32A, 32B and 32C make the top of the frame wider than the bottom of the frame, which imposes a spring tension to the vertical uprights 26, 26A, 26B and 26C when they are sprung to approximately 90 degrees when fitting a gusseted plastic bag. The approximate 86 degree bends of each frame assisted by offset bends 34, 34A, 34B and 34C provide for this spring tension. The solid round bar used to form the bag stand 49 are tempered ½ hard to ensure consistent spring tension. The horizontal supporting sections 24 and 24A have approximately 1½ degree bends or bows 36 and 36A to elevate the center portion of the support sections to compensate for rounding when vertical uprights 26, 26A, 26B and 26C are sprung from their approximately 86 degree angle to an approximate 90 degree angle when fitting a gusseted plastic bag over the top perimeter of the plastic bag stand 49.

The assembled bag stand 49 when viewed from the top as shown in FIGS. 1 and 2, has an open generally square shape over which a gusseted plastic bag can be fitted in a mouth-open condition. The approximate 90 degree bends 38, 38A, 38B and 38C connecting the vertical uprights 26, 26A, 26B and 26C to the top horizontal sections 28, 28A, 28B and 28C have a small radius which project against and form pockets in the gusseted plastic bag to assist in holding it. The main or primary support to hold the gusseted plastic bag in a mouth-open condition in the bag stand is provided by the double slotted plastic connectors 22 and 22A of FIGS. 3A, 3B and 3C. The connectors project vertically downward from their pivotal attachment points with extensions 30, 30A, 30B and 30C, and provide open slots 42, 42A, 42B and 42C having integral clamps 44, 44A, 44B and 44C therein by which plastic bag handles or cuffed edges of plastic bags without handles can be detachably held. The slots 42, 42A, 42B and 42C are of sufficient size to hold a five to seven days supply of gusseted plastic bags with or without handles which can be removed one at a time when filled by unhooking handles from slots 42, 42A, 42B and 42C, or by pulling the clamped edges from under clamps 44, 44A, 44B and 44C and lifting up and out. The perimeter of the top opening of the bag stand 49 is larger by twelve to fifteen percent than the predetermined perimeter of the gusseted plastic bag to provide for a snug fit.

Figure 4:
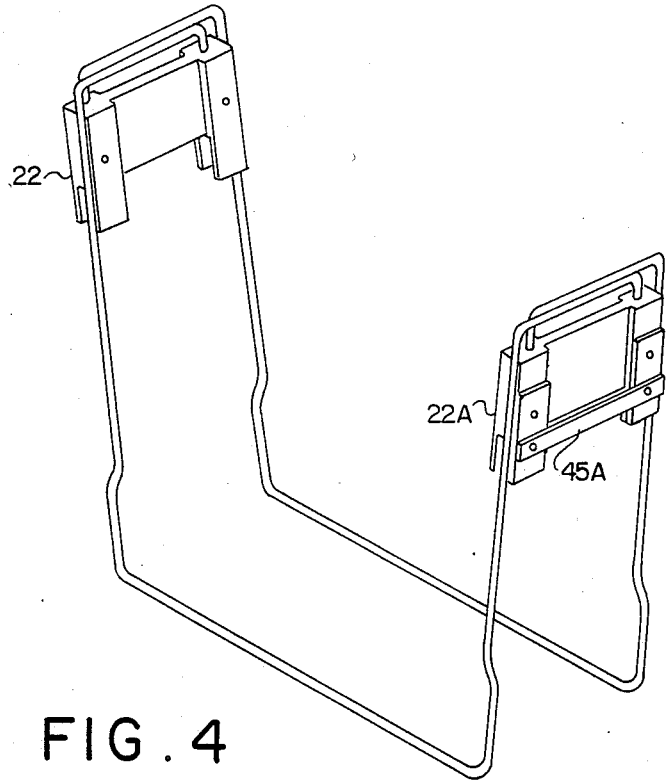
FIG. 4 is a perspective view of the bag holder in collapsed position as for shipping or storage.

The height of the vertical uprights 26, 26A, 26B and 26C of the bag stand are so proportioned to the length of the open plastic bag that most of the weight of a full plastic bag when secured to the top of the bag stand is supported by the surface on which the bag stand is supported. Only a small portion of the weight of the full plastic bag is supported by the top section of the bag stand. The moulded plastic connectors 22 and 22A of FIG. 3 act as pivots to allow the bag stand 49 as shown in FIG. 2, to be folded up to approximately fifty percent of its operating size as shown in FIG. 4. This enables assembly of the bag stand before shipment and requires approximately fifty percent less space for storage and shipment.

In use of the embodiment illustrated in FIG. 2, gusseted plastic bags with handles are placed within the bag holder 49 with the bag handles near the vertical uprights. The handle on one side of the bag is hooked into the double slots 42 and 42A, with the handle seam-centered. The other handle is adapted to be hooked inside slots 42B and 42C and seam-centered. However, to accomplish this, it is necessary to springably move the vertical uprights toward each other to place the second handle in double slots 42B and 42C. The plastic bag open end is then cuffed and engaged over the top sections of the vertical uprights while they are held in their inwardly displaced position. Upon release, the vertical uprights spring outwardly and expand and hold the mouth of the bag in open position. When a single plastic bag is used and is full, the handles are removed from double slots 42, 42A, 42B and 42C and pulled up and out. As the plastic bag is uncuffed from the perimeter of the bag stand 49, the vertical supports spring farther apart, allowing the full plastic bag to be easily withdrawn from the bag stand. To save time, and as a matter of convenience, several days supply of plastic bags may be fitted over and within bag holder 49. The slots 42 through 42C have sufficient space to hold the cuffed edges. The plastic bags can be filled and removed one at a time.

Figure 5:
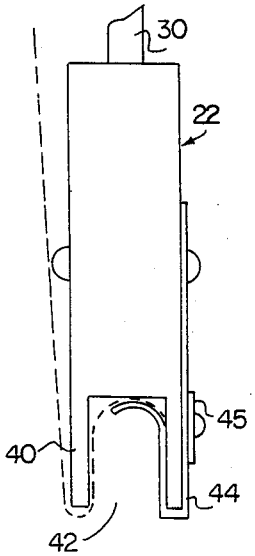
FIG. 5 is a side elevational view of a moulded plastic connector showing how a plastic bag without handles is clamped in slots in the connector.

To use the embodiment of FIG. 2 to support limp plastic bags without handles, a gusseted plastic bag without handles is placed within the bag holder 49 with the gussets facing the open sides. The open mouth of the plastic bag is cuffed over top horizontal sections 28 and 28A and down on vertical uprights 26 and 26C. The vertical uprights 26, 26A, 26B and 26C are then springably moved together to cuff the plastic bag over horizontal sections 28B and 28C and associated vertical uprights 26A and 26B when both sides are cuffed and are sized to 1½" below plastic connectors 22 and 22A, FIG. 3. The latch bars 45 and 45A are moved down against springs 46, 46A, 46B and 46C, and clamps 44, 44A, 44B and 44C are moved laterally to the side to clear slots 42, 42A, 42B and 42C. The edges of the cuffed plastic bags are then folded up inside slots 42, 42A, 42B and 42C, FIG. 5, and the latch bars 45 and 45A and clamps 44, 44A, 44B and 44C are springably moved back into the slots on top of folded the edges as illustrated in FIG. 5.

When the plastic bag is filled, the cuffed edges are pulled from under clamps 44, 44A, 44B and 44C and the full plastic bag is pulled up and out. When the plastic bag uncuffs, the frame vertical uprights 26, 26A, 26B and 26C spring apart allowing the full plastic bag to be easily withdrawn. To save time, several days supply of plastic bags can be fitted over and within bag holder 49. The slots 42, 42A, 42B and 42C have sufficient space to hold five to seven plastic bags. The plastic bags can be filled and removed one at a time.

Referring to FIGS. 2 and 4, it should be noted that FIG. 2 shows the bag stand in extended condition, while FIG. 4 shows the bag stand in collapsed condition. The collapsed condition of FIG. 4 is achieved simply by rotating each of the connectors 22 and 22A 180 degrees about a vertical axis, thereby drawing the two frame members toward each other as shown in FIG. 4.

A second preferred embodiment employing single slotted moulded plastic connectors at each end of the bag stand is illustrated in FIGS. 6, 7A and 7B. The bag stand of this embodiment is designated generally by the numeral 79 and comprises a two-legged frame configuration made by bending solid round bar into two frame sections designated generally by the numerals 50 and 50A, which are connected together at opposite ends by slotted plastic connectors 52 and 52A (FIG. 7) to form the composite stand 79 to which gusseted limp plastic bags with or without handles and of a predetermined size with an opening at the top thereof can be attached and supported by the two frame sections 50 and 50A which are mirror images of each other. The frame sections 50 and 50A are substantially identical to the frame sections 20 and 20A of FIG. 2. They are made from a continuous solid round bar or rod with horizontal supporting sections 56 and 56A, vertical uprights 58, 58A, 58B and 58C, and horizontal top sections 54, 54A, 54B and 54C which are perpendicular to and approximately one-half as long as horizontal supporting sections 56 and 56A, ending in short vertical downward sections 60, 60A, 60B and 60C, all connected together with smooth-radius bends. It should be noted here that the only difference in frames 50 and 50A as compared with frames 20 and 20A of FIG. 2 lies in the longer length of the horizontal top sections 54, 54A, 54B and 54C.

The two frames, 50 and 50A are connected together into a composite stand by slotted moulded plastic connectors 52 and 52A (FIG. 7), which are mirror images of each other. When viewed from the open side (FIG. 6), the approximate 86 degree bends 62, 62A, 62B and 62C make the top wider than the bottom, which gives a spring tension to the vertical uprights 58, 58A, 58B and 58C when they are displaced to approximately 90 degrees when fitting the gusseted plastic bags on the bag stand 79. The approximately 86 degree bends are assisted by offset bends 64, 64A, 64B and 64C to provide this spring tension. The solid round bar used to make the bag stand 79 is tempered ½ hard which provides consistent spring tension.

The horizontal supporting sections 56 and 56A have approximately 1½ degree bends 66 and 66A to raise up or bow the center portion of these members to prevent rounding of the horizontal supporting sections 56 and 56A when vertical supports 58, 58A, 58B and 58C are displaced inwardly toward each other from their approximately 86 degree angle to their approximately 90 degree angle when fitting gusseted plastic bags over the top perimeter of the bag stand 79. The bag stand 79, when viewed from the top, has an open generally square shape over which a gusseted plastic bag can be fitted in a mouth-open condition. The approximately 90 degree bends 68, 68A, 68B and 68C between the vertical uprights 58, 58A, 58B and 58C and the top horizontal sections 54, 54A, 54B and 54C have a small radius which form pockets in the gusseted plastic bags to assist in holding them.

The main support to hold the gusseted plastic bags in a mouth-open condition on the bag stand is provided by the slotted plastic connectors 52 and 52A (FIG. 7) which project vertically downward from their attachment points with sections 60, 60A, 60B and 60C to provide extensions 70 and 70A that define open slots 72 and 72A equipped with pivotal clamps 74 and 74A by which plastic bag handles or cuffed edges of plastic bags without handles can be releasably held. The slots 72 and 72A are of sufficient size to hold a five to seven days supply of gusseted plastic bags with or without handles which can be removed one at a time when filled by unhooking the handles from slots 72 and 72A, or pulling the clamped edges from under clamps 74 and 74A and lifting up and out.

The perimeter of the top opening of the bag stand 79 is larger by twelve to fifteen percent than the predetermined perimeter of the gusseted plastic bag to provide a snug fit. The height of the bag stand 79 vertical uprights 58, 58A, 58B and 58C is so proportioned to the length of the open gusseted plastic bag that most of the weight of a full plastic bag when secured to the top section is supported by the surface on which the plastic bag and bag stand are supported. Only a small portion of the full weight of the plastic bag is supported by the top section of the bag stand.

In use of the embodiment illustrated in FIG. 6, gusseted plastic bags with handles are placed within the bag holder 79 with the bag handles near the vertical uprights. The handle on one side of the bag is hooked into the single slot 72 with the handle seam centered. The other handle is adapted to be hooked inside slot 72A and seam centered. However, to accomplish this, it is necessary to springably move the vertical uprights toward each other to place the second handle in slot 72A. The plastic bag open end is then cuffed and engaged over the top sections of the vertical uprights while they are held in their inwardly displaced position. Upon release, the vertical uprights spring outwardly and expand and hold the mouth of the bag in open position. When a single plastic bag is used and is full, the handles are removed from slots 72 and 72A and pulled up and out. As the full plastic bag is uncuffed from the top perimeter of the bag stand 79, the vertical uprights spring farther apart, allowing the full plastic bag to be easily withdrawn from the bag stand. To save time, and as a matter of convenience, several days supply of plastic bags may be fitted over and within bag holder 79. The slots 72 and 72A have sufficient space to hold the handles, and full plastic bags can be removed one at a time.

Use of the bag stand embodiment of FIG. 6 with gusseted plastic bags *without* handles entails placing one or more plastic bags within the holder 79 with the bag gussets facing the open sides. The open mouth is cuffed over one side of the vertical uprights 58 and 58A. The vertical uprights 58, 58A, 58B and 58C are springably moved together to cuff the other side. The cuffs are sized to approximately 1½" below extensions 70 and 70A of slotted connectors 52 and 52A (FIG. 7). The clamps 74 and 74A are springably moved down and pivoted to the side clear of slots 72 and 72A. The edges of the cuffed plastic bags are folded up inside slots 72 and 72A. The clamps 74 and 74A are then again moved down against springs 75 and 75A and moved into slots 72 and 72A on top of the folded-up edges of the cuffed plastic bag.

When a single bag is used and is filled, the cuffed edges are pulled from under clamps 74 and 74A and pulled up and out. As the plastic bag is uncuffed from the top perimeter of the bag stand 79, the vertical uprights, now free of the constraints imposed by the bag, spring apart, allowing the full plastic bag to be easily withdrawn. To save time, several days supply of plastic bags may be fitted over and within the bag holder. The slots 72 and 72A have sufficient space to hold the cuffed edges. The plastic bags can be filled and removed one at a time.

Figure 8:
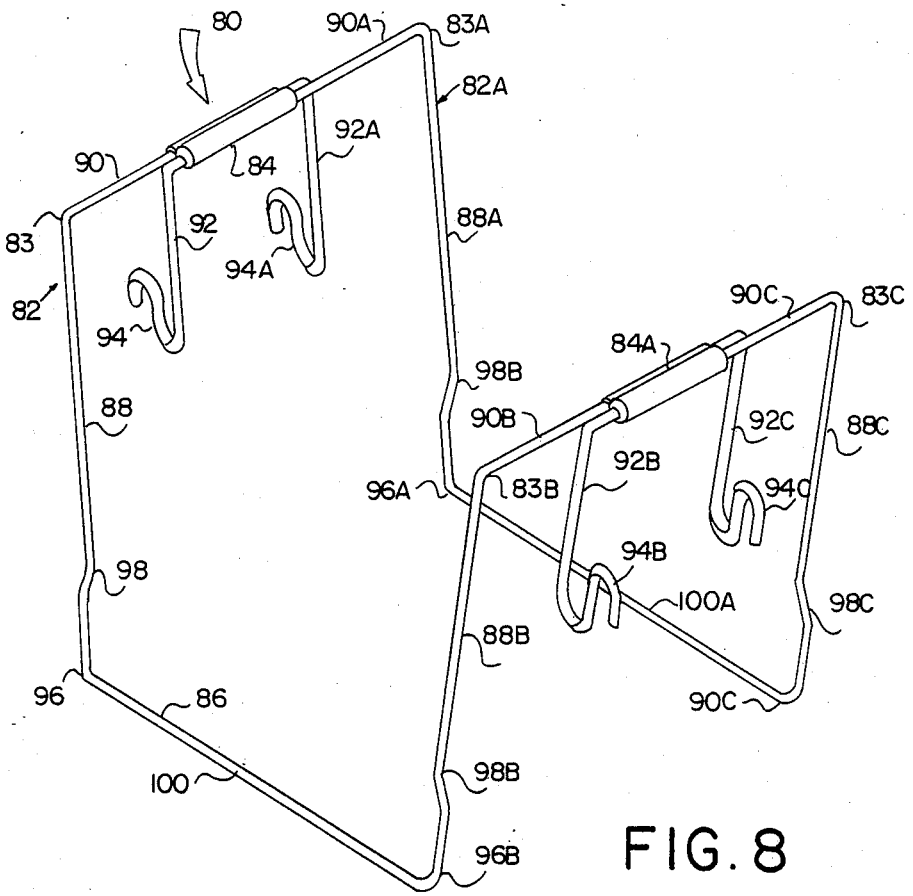
FIG. 8 is a perspective view of a third embodiment of a bag stand for limp plastic bags.
Figure 9A:
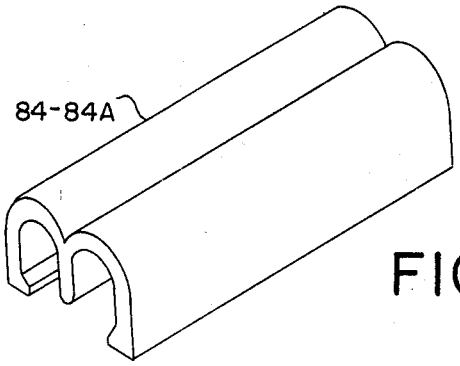
FIGS. 9A, 9B and 9C are perspective view, end view, and partial cross-sectional views, respectively, of moulded plastic connectors utilized in the embodiment of FIG. 8.

The third embodiment of the invention is shown in FIGS. 8 and 9A, B and C. The bag stand designated generally by the numeral 80 comprises a two-legged frame configuration formed by bending solid round bar into two frame sections designated generally by numerals 82 and 82A, which are slidably connected together with moulded plastic connectors 84 and 84A to form composite bag stand 80 to which gusseted plastic bags with handles of predetermined sizes and with an opening at the top thereof can be attached and supported by the two frame sections 82 and 82A which are mirror images of each other. They are formed from continuous solid round bar with horizontal supporting sections 86 and 86A, vertical uprights 88, 88A, 88B and 88C, horizontal top sections 90, 90A, 90B and 90C which are perpendicular to and approximately three-quarters the length of the horizontal supporting sections 86 and 86A, with the ends 92, 92A, 92B and 92C projecting vertically downward about one third the length of the vertical uprights 88, 88A, 88B and 88C, ending in two double hooks 94, 94A, 94B and 94C which are perpendicular to and extend outward from top horizontal sections 90, 90A, 90B and 90C.

Figure 9B:
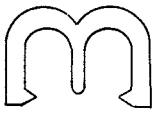
Figure 9C:
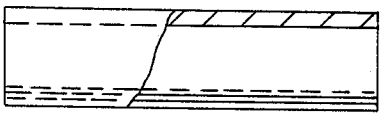

These top horizontal sections lap each other in a juxtaposed parallel position as shown. The moulded plastic connectors 84 and 84A (FIG. 9), which are mirror images of each other, are approximately one quarter the length of the horizontal support sections 86 and 86A. They are so designed as to snap snugly and resiliently over both top parallel sections 90, 90A, 90B and 90C to form a slidable connection between the two frame sections 82 and 82A. When viewed from the open side as in FIG. 8, the approximate 86 degree bends 96, 96A, 96B and 96C make the top wider than the bottom which gives a spring tension to the vertical uprights 88, 88A, 88B and 88C when they are displaced inwardly to approximately 90 degrees. When fitting the gusseted plastic bags, the approximate 86 degree bends, assisted by set bends 98, 98A, 98B and 98C provide the spring tensions. The solid bars or rods used to form the bag stand 80 are tempered ½ hard which provides consistent spring tension.

The horizontal supporting sections 86 and 86A have approximately 1½ degree bends 100 and 100A to raise up or bow the center portions to prevent rounding when the vertical sections 88, 88A, 88B and 88C are displaced from their approximate 86 degree angle to an approximate 90 degree angle when fitting gusseted plastic bags over the top perimeter of the bag stand 80. The assembled bag stand 80, when viewed from the top as in FIG. 8, has an open generally square shape over which a gusseted plastic bag can be fitted in a mouth-open condition. The approximate 90 degree bends between the vertical uprights 98, 98A, 98B and 98C and the top horizontal sections 90, 90A, 90B and 90C have a small radius which forms pockets in the gusseted plastic bags to assist in holding them in a mouth-open condition. The main support to hold the gusseted plastic bags in a mouth-open condition is provided by the double hooks 94, 94A, 94B and 94C projecting downward from the top horizontal sections 90, 90A, 90B and 90C which, along with the 90 degree bends at the corners of the top sections 90, 90A, 90B and 90C, and the spring action of the vertical uprights 88, 88A, 88B and 88C, and the hooks 94, 94A, 94B and 94C, hold the gusseted plastic bag handles.

The hooks are of sufficient size to hold a five to seven days supply of gusseted plastic bags with handles, which can be filled and removed one at a time. The perimeter of the top opening of the bag stand 80 is larger by about twelve to fifteen percent than the predetermined perimeter of the gusseted plastic bags to provide a snug fit. The design of the horizontal plastic connectors provide for lateral adjustment of the two frames 82 and 82A (FIG. 8) parallel to the double hooks 94, 94A, 94B and 94C to compensate for the variation in sizes of gusseted plastic bags. The height of the bag stand 80 vertical uprights 88, 88A, 88B and 88C are proportioned to the length of the open gusseted plastic bag so that most of the weight of a full plastic bag when secured to the top is supported by the surface on which the bag and the bag stand are supported. Only a small portion of the weight of the full plastic bag is supported by the top section of the bag stand. The horizontal plastic connectors 84 and 84A allow the bag stand to be reduced in size by thirty percent, which enables assembly before shipment and requiring thirty percent less space for storage and shipment.

In use, the embodiment of the invention illustrated in FIG. 8, is quite versatile. If the plastic bags in use are undersized, the bag stand 80 may be laterally adjusted parallel to the double hooks on each side by pushing together frames 82 and 82A causing the horizontal sections 90, 90A, 90B and 90C to slide in the connectors. The plastic bags with handles are placed within the bag holder 89 with the handles near the double hooks 94, 94A, 94B and 94C. The handle on one side of the bag is placed in the double hooks 94 and 94A with the handle seam centered. At this point, it is necessary to springably move vertical uprights 88, 88A, 88B and 88C toward each other to place the other handle seam centered in the double hooks 94B and 94C. The plastic bag is then cuffed over the top horizontal sections 90, 90A, 90B and 90C and vertical uprights 88, 88A, 88B and 88C. As stated above, it is necessary to springably move vertical uprights 88, 88A, 88B and 88C together to accomplish this. For final adjustment, frames 82 and 82A may be moved outward to tighten the plastic bag. The open-mouthed plastic bag secured in the bag stand 80 is now ready to receive household refuse. When a single plastic bag is used and is full, the handles are removed from double hooks 94, 94A, 94B and 94C and pulled up and out. As the plastic bag is uncuffed from the perimeter of the bag stand 80, the vertical uprights 88, 88A, 88B and 88C spring apart, allowing the full bag to be easily withdrawn. To save time, five to seven days supply of plastic bags can be fitted over and secured to the bag holder 80. The double hooks 94, 94A, 94B and 94C have sufficient space to hold the handles. The plastic bags can be filled and removed one at a time.

Thus, in summary, it can be seen that round, solid bar or rod stock can be formed into bag holders or bag stands that easily support and hold gusseted limp plastic bags with or without handles. Using the moulded plastic connectors with extended slots equipped with clamps as illustrated and described to hold the handles or cuffed edges of gusseted plastic bags is a great convenience. The third preferred embodiment designed for gusseted plastic bags with handles using double hooks on two sides to which the bag handles may be anchored are also very practical. The cost of the bag holder or stands is reasonable in price because of its simplicity, thus making it available to a wide range of users. Moreover, when a supported plastic bag is filled, the plastic bag can be easily removed.

While the foregoing description and the drawings contain many specificities, these should not be construed as limitations of the scope of the invention, but rather as exemplifications of the preferred and alternate embodiments thereof. Other variations are possible within the scope of the appended claims. For example, the moulded plastic connectors can be horizontally pivoted whereby the extended slots could be rotated up to receive the handles and then rotated out and down. Accordingly, the full scope of the invention should be determined not by the examples given, but by the appended claims.

We claim:

1. A bag stand for supporting one or more limp plastic bags with or without handles and each having an opening at the top thereof in an upright open-mouth condition, comprising:

(a) a pair of parallel mutually facing generally U-shaped frame members, each frame member of the pair including a horizontal support member of predetermined length lying in spaced parallelism in a common plane with the corresponding horizontal support member of the other frame member and having a pair of upright members integral with opposite ends of the horizontal support member, each upright member of each pair thereof at its end remote from said horizontal support member being integral with a horizontal top section extending substantially perpendicular to said associated upright member and said horizontal support member and parallel with the horizontal top section extending integrally from the other upright member of the pair, each said horizontal top section of each frame at its end remote from the associated upright member terminating in vertical sections perpendicular to the associated horizontal top section and parallel with the associated upright member; and (b) means connecting the mutually reaching corresponding horizontal top sections of said pair of mutually facing generally U-shaped frame members whereby said frame members are retained in spaced juxtaposed relationship to form a stand on which a limp plastic bag may be supported in upright open-mouth condition when applied to said stand.

2. The bag stand according to claim 1, in which said upright members of said pair thereof on each U-shaped frame diverge in the direction of said horizontal top sections and lie in a common plane including said horizontal support member.

3. The bag stand according to claim 1, in which said horizontal support member of each U-shaped frame is bowed in a direction perpendicular to the long dimension thereof.

4. The bag stand according to claim 3, in which said horizontal support member is bowed in the direction in which said upright members extend.

5. The bag stand according to claim 1, in which the mutually reaching corresponding horizontal top sections of said pair of U-shaped frames lie in a common plane.

6. The bag stand according to claim 5, in which the mutually reaching corresponding horizontal top sections are parallel and juxtaposed, and said means connecting said horizontal top sections slidably lock said horizontal top sections in juxtaposed relationship, whereby said juxtaposed horizontal top sections may be axially displaced in relation to one another to vary the size of the bag stand.

7. The bag stand according to claim 1, in which said means connecting said mutually reaching corresponding horizontal top sections engage said vertical termination sections of said mutually reaching corresponding horizontal top sections.

8. The bag stand according to claim 7, in which said connecting means for said U-shaped frames pivotally engage said vertical termination sections.

9. The bag stand according to claim 7, in which said connecting means for said U-shaped frames non-rotatably engage said vertical termination sections.

10. The bag stand according to claim 1, in which said means connecting said mutually reaching corresponding horizontal top sections of said U-shaped frames pivotally engage corresponding vertical termination sections thereof, whereby said means connecting said mutually reaching corresponding horizontal top sections may be selectively pivoted about a vertical axis to shift said mutually reaching corresponding horizontal top sections from an axial alignment relationship into a juxtaposed parallel relationship to thereby diminish the spacing between said mutually facing U-shaped frame members.

11. The bag stand according to claim 1, in which said means connecting said mutually reaching corresponding horizontal top sections of said U-shaped frames slidably engage corresponding horizontal top sections thereof, whereby said U-shaped frames may be selectively adjusted toward or away from each other to vary the spacing therebetween to accommodate limp plastic bags of different size.

12. The bag stand according to claim 1, in which said means connecting said mutually reaching corresponding horizontal top sections include clamp means for removably attaching one or more limp plastic bags to said bag stand.

* * * * *